United States Patent [19]

Terry

[11] 4,020,511

[45] May 3, 1977

[54] FOAM BED PILLOW

[75] Inventor: Samuel M. Terry, Ann Arbor, Mich.

[73] Assignee: Hoover Ball and Bearing Company, Saline, Mich.

[22] Filed: May 28, 1975

[21] Appl. No.: 581,495

[52] U.S. Cl. ..... 5/337; 5/361 B; 264/54

[51] Int. Cl.[2] ..... A47G 9/08

[58] Field of Search ..... 5/337, 345, 347, 361 B; 297/DIG. 1

[56] References Cited

UNITED STATES PATENTS

| | | | |
|---|---|---|---|
| 2,785,739 | 3/1957 | McGregor et al. | 5/361 B |
| 3,163,687 | 12/1964 | Einhorn | 297/DIG. 1 |
| 3,363,352 | 1/1968 | Pachmayr | 297/DIG. 1 |
| 3,381,999 | 5/1968 | Steere | 5/347 |
| 3,866,252 | 2/1975 | Rogers, Jr. | 5/337 |

FOREIGN PATENTS OR APPLICATIONS

| | | | |
|---|---|---|---|
| 1,090,785 | 4/1955 | France | 5/347 |
| 438,792 | 11/1935 | United Kingdom | 5/361 B |

*Primary Examiner*—Jacob Shapiro
*Attorney, Agent, or Firm*—Olsen and Stephenson

[57] ABSTRACT

A one-piece bed pillow consisting of a pillow shaped molded body of open cell urethane foam material having its outer surface formed with a regular pattern of interconnected grooves. The pillow is formed in a mold which is placed in an upright position during foaming of the pillow body so that in use the pillow has a plurality of internal cells which are generally perpendicular to the direction in which load is applied to the pillow to thereby impart desirable load-deflection characteristics to the pillow so that it has low resistance to initial load and has increased resistance to higher loads. The user of the pillow thus finds that it has a desirable initial softness with a subsequent firmness that gives the user confidence in the ability of the pillow to hold the user's head.

2 Claims, 3 Drawing Figures

FOAM BED PILLOW

BACKGROUND OF THE INVENTION

The desirability of molded foam as a bed pillow material has been generally known in the bedding industry for many years. Molded latex pillows have been in common use for a long time. However, the rubber pillows have been found to be objectionable because they inherently impart a "fight-back" feel to the head of the user. Furthermore, latex pillows do not have the soft down-like feel normally associated with a comfortable pillow. It is an object of the present invention to provide an improved one-piece molded pillow formed from an open cell urethane foam that has the desired softness and support characteristics associated with a comfortable pillow.

SUMMARY OF THE INVENTION

The present invention consists of a one-piece bed pillow comprising a pillow shaped molded body of open cell urethane foam material having an outer surface formed with a regular pattern of interconnected surface grooves which act to impart surface softness to the pillow. The normal skin which is found on a molded urethane body and which would thus have to be stretched in order for the pillow to yield is thus avoided by the surface grooving of the pillow body. This construction imparts the desired softness to the pillow of this invention and gives the pillow the desirable initial yieldability associated with user comfort. According to the method of this invention, the molded urethane foam pillow is formed in a mold that is located in a generally upright position. The chemical components which react to form the foam body are mixed together immediately prior to introduction into the mold cavity. The resulting liquid mixture is introduced through an opening in the upper portion of the mold cavity, falls by gravity into the lower portion of the cavity and begins to expand. This rising action within the confines of the mold cavity creates within the foam body a large number of air cells which have their largest dimension extending in the direction of foaming, namely, in an upright direction. As a result, when the foam body is removed from the mold and placed in a normal supporting position for a bed pillow, the load on the pillow of the user's head is generally transversely of the direction of the cells within the foam body.

This orientation of the cells gives the pillow of this invention the desired load-deflection characteristics normally associated with pillow comfort. Stated otherwise, this orientation of the foam cells in the body gives the pillow of this invention a high sag factor. The sag factor, generally associated with pillow comfort, is the ratio of the load required to compress the pillow to 65% of its original depth divided by the load required to compress the pillow to 25% of its original depth. The sag factor, or comfort factor, is in essence a numerical representation of the fact that a pillow user wants the pillow to be soft and thus readily deflect during the first 25% of its compression but to then develop an increasing resistance to load as the compression continues. This latter effect is represented by the high load required to deflect the pillow of this invention 65% of its original depth. Tests have indicated that the pillow of this invention has a sag factor of 3.5. A sag factor of this magnitude is generally associated with user comfort.

In summary, therefore, the pillow of this invention is improved from the standpoint of user comfort. By virtue of the fact that it is formed of urethane, it is sterilizable by heating, can be washed, and is highly resistant to ignition. The method of this invention enables economical manufacture of the pillow in large numbers and imparts the cell orientation to the pillow that provides improved comfort to the user.

Further objects, features and advantages of this invention will become apparent from a consideration of the following description, the appended claims, and the accompanying drawing in which:

Figure 1:
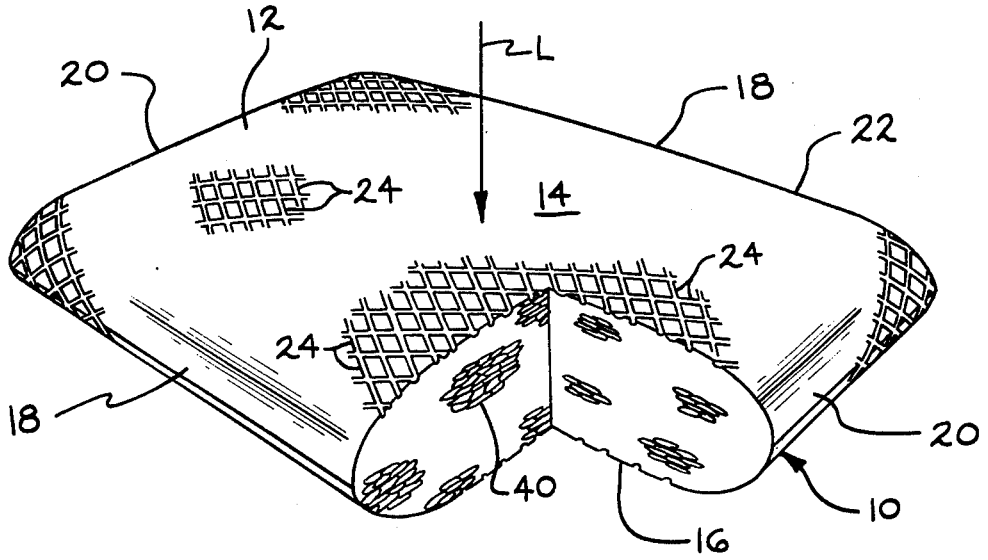
FIG. 1 is a perspective view of the pillow of this invention with a portion broken away for the purpose of clarity.
Figure 2:
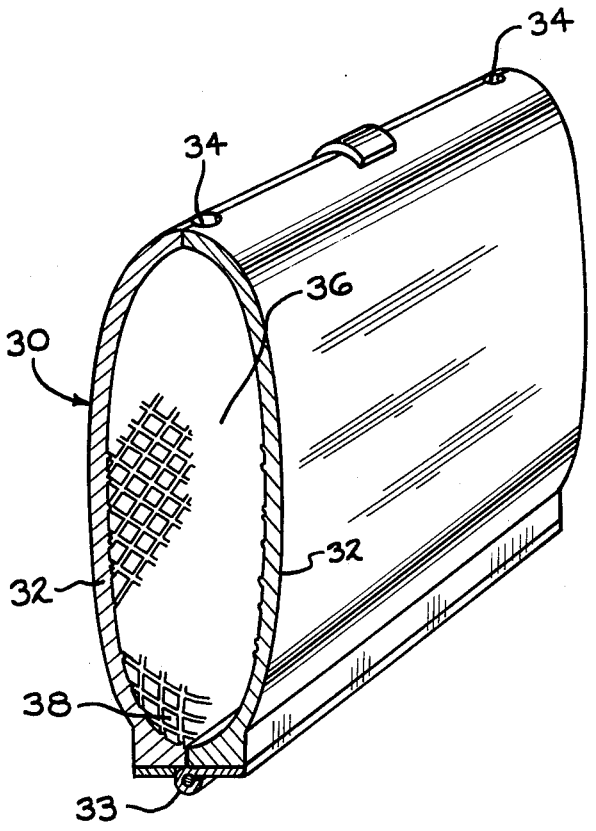
FIG. 2 is a perspective view, with some parts broken away and other parts shown in section, of the mold employed in the method of this invention to form the pillow shown in FIG. 1.

With reference to the drawing, the pillow of this invention, indicated generally at 10, is shown in FIG. 1 as consisting of a one-piece molded foam body 12 having top and bottom surfaces 14 and 16, sides 18 and ends 20. As shown in FIGS. 1 and 2, the outer surface 22 of the body 12 is formed with a regular pattern of surface depressions or grooves 24. Importantly, the grooves 24 break up the surface 22 so as to eliminate the inclusion in the molded pillow 22 of an outer skin that must be stretched in order to depress the pillow. The grooves 24 thus impart a feeling of surface softness to the pillow 10, which is highly desirable from the standpoint of user comfort. The grooves 24 are arranged in a regular pattern in the surface 22 and in a preferred embodiment of the invention illustrated in the drawing, the grooves 24 are arranged in a regular criss-cross diamond pattern in the pillow body 12. The grooves also act to mask the small imperfections that are inevitably formed in the surface 22 during molding.

In the manufacture of the molded body 12, a mold, such as the one indicated at 30 in FIG. 2, is employed. The mold 30 consists of upright mold halves 32 which are connected at their lower ends by a hinge 33 and are provided at their upper ends with ports 34 through which the raw material that forms the body 12 is introduced and through which gas escapes from the cavity 36 formed within the mold by the mold halves 32. The mold halves 32 are structured so that the cavity 36 conforms in shape to the desired shape for the one-piece molded pillow body 12. As shown in FIG. 2, the mold 30 is positioned in a generally upright position so that the lower end 38 of the mold cavity 36 corresponds to one side 18 of the molded pillow body 12 formed in the mold 30.

The basic raw materials used in the production of flexible urethane foams are generally well known throughout the cellular plastics industry. The various ways in which the materials may be treated or preblended prior to producing a cellular product are also well known. In the present example, a two-component system is employed. This system consists of the following ingredients, the details of which form no part of the present invention:

| Material | Parts by weight |
|---|---|
| Polyol 593 (Wyandotte Chemical Co.) | 78.0 |
| Polyol 4542 (Wyandotte Chemical Co.) | 22.0 |
| Water | 2.8 |
| Triethylamine (Catalyst) | 0.30 |
| Dabco LV-33 (Catalyst) | 0.45 |
| Silicone Surfactant DC-192 (Dow Corning) | 1.0 |
| Monofluorotrichloromethane (R-11) | 12.0 |
| Dibutyltin-dilaurate | 0.03 |
| Tolylene Diisocyanate (TDI) (80:20 mixture of 2,4-and 2,6-isomers, respectively) | 35.0 |

All ingredients in the formulation, except TDI, are preblended and kept under constant agitation to prevent separation of the polyols. This blend constitutes one component of the two-component system; TDI constitutes the second component of the system.

When the two components of the system are mixed together to form a reaction mixture immediately prior to introduction into the mold cavity, two concurrent reactions begin to take place. The polyols begin to react with the TDI to build up large polymeric molecules which eventually develop into a rubber-like product. At the same time, however, water also reacts with the TDI with the formation if carbon dioxide gas. In the course of these reactions, heat is generated, leading to volatilization of R-11, which assists to $CO_2$ in expanding the reacting mass.

The gas initially produced in the mold dissolves in the liquid reacting mixture, but within a matter of a few seconds, saturates the system and begins to escape, forming a discontinuous gas phase of tiny bubbles or cells distributed throughout the mass. These cells form and grow as the liquid continuous phase begins to develop visco-elastic properties. At a critical point, sometimes called "the gel point," the cell wall film loses its ability to flow as a liquid and ruptures under the increasing pressure of the contained gas, resulting in a network of highly interconnected cells. Crushing of the foam mass after demolding results in rupture of residual closed cells to yield a highly open-celled product. The mold is preferably maintained in an oven in which the oven temperature is 250° F for fifteen minutes minimum. The reacting urethane raw materials within the lower portion of the mold cavity 36 results in a foaming and upward flow of the material within the cavity 36. While the foam is expanding in the mold, the ports 34 are closed, further gas escape taking place through gas escape channels (not shown) cut into the upper corners of the mold. The mold 30 is subsequently opened and a molded pillow body 12 is removed therefrom. Some subsequent heat curing of the pillows may be desirable following molding. The highly open structure of the pillow body 12 permits ready passage of air therethrough and prevents heat build-up within the body. This structure of the pillow body 12 obviates the necessity of coring during molding to provide air circulation passages during use of the pillow.

As shown in FIG. 1, the pillow body 12 is provided with a multitude of internal open cells 40 which are elongated in the direction in which foaming flow took place within the mold cavity 36. Because the mold cavity 36 was maintained in an upright position during foaming, the cells 40 run in a direction from side 18 to side 18 in the pillow body 12. As a result, the cells 40 extend in generally the same direction as the pillow top surface 14. Stated otherwise, these cells 40 are extended in a direction which is perpendicular to the direction in which a load L (FIG. 1) is normally applied to the top surface 14 of the pillow body 12. It has been found that these cells 40 as shaped and oriented in the body 12 such that they impart an anisotropic character to the foam body 12. The particular orientation and shape of the cells 40 in the body 12 thus affects the load-deflection characteristics of the body 12.

Figure 3:
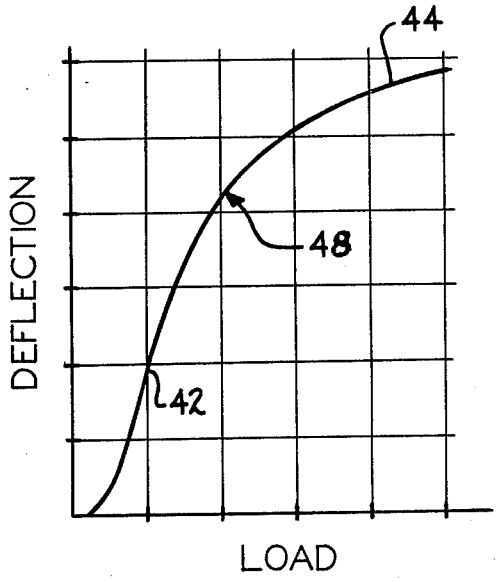
FIG. 3 is a load-deflection curve for the pillow of this invention.

The curve 48 in FIG. 3 graphically illustrates the increase in deflection of the body 12 as the load L is increased. The curve 48 indicates that when the body 12 is initially loaded, indicated by the portion 42 of the curve 48, a small load provides a substantial deflection of the body 12. As the body deflects further, however, greater loads are required to accomplish deflection. In other words, when higher loads are placed on the body 12, as indicated by the portion 44 of the curve 48, the deflection of the body 12 is much less.

In terms of user comfort, the load-deflection characteristics of the body 12, as shown by curve 48, means that a user who initially places his head on the pillow 10 enjoys a feeling of comfort by virtue of the softness of the pillow 10 and the ability of the pillow 10 to yield readily to this initial load. However, as the user places greater weight on the pillow 10, the pillow 10 imparts a greater feeling of lift to the user, therby giving the user a feeling of confidence that the pillow body 12 will firmly support the user's head. The sag factor, or comfort factor, is expressed as the ratio of the load required to produce a 65% deflection of the body 12 in the vertical direction of the load L with respect to the load required to produce 25% deflection. Tests of the pillow of this invention have shown that the sag factor is 3.5, which is a highly desirable sag factor.

From the above description, it is seen that this invention provides an improved pillow 10 consisting of a one-piece molded urethane body 12 having highly desirable comfort characteristics. While the pattern of grooves 24 on the surface 14 have been illustrated as being of diamond shape, other shapes may be employed, such as clover leafs, triangles, circles, etc.

The cavities that must be formed in the inner surfaces of the mold 30 in order to form the diamond or other pattern on the surface of the pillow body 12 can be connected to improve the escape of gas from the mold cavity 36 during the molding of a pillow therein. The size of each surface cavity in the mold 30, and thus the distance between adjacent grooves 24 in the pillow body 12, is great enough to prevent the foam in the mold cavity 36 from bridging over the diamond shape cavities in the mold surface. However, the mold inner surfaces are configured so that the pillow grooves 24 are sufficiently close together to break up the skin which might otherwise impede flexing of the pillow surfaces 14 and 16 enough to give the pillow 10 a permanent soft down-like feel.

What is claimed is:

1. A one-piece bed pillow comprising a pillow shaped molded body of open cell urethane foam material having a continuous outer surface, said body being adapted to be placed in a generally horizontal load supporting position in which it has a top load supporting surface, ends and sides, said outer surface being formed with a regular pattern of shallow surface depressions, substantially all of said depressions being interconnected to thereby impart surface softness to said body member, said body member having a plurality of internal interconnected elongated open cells extending in generally the same direction as said load supporting surface to thereby provide said body with desirable load-deflection characteristics wherein said pillow has a soft resistance to initial load and has increased resistance to larger loads.

2. A foam pillow according to claim 1 wherein said cells in said body are elongated in a direction extending from side to side thereof so that said cells extend in directions generally transversely of the direction of downwardly directed loads applied to said load supporting surface.

* * * * *